US005505010A

United States Patent [19]

Fukuoka

[11] Patent Number: 5,505,010

[45] Date of Patent: Apr. 9, 1996

[54] VENTILATING SHOES

[75] Inventor: Sadao Fukuoka, Tokushima, Japan

[73] Assignee: Fukuoka Chemical Industry Co., LTD., Tokushima, Japan

[21] Appl. No.: 241,180

[22] Filed: May 11, 1994

[30] Foreign Application Priority Data

May 12, 1993 [JP] Japan ..... 5-110279
Mar. 15, 1994 [JP] Japan ..... 6-043550

[51] Int. Cl.[6] ..... A43B 7/06

[52] U.S. Cl. ..... 36/3 B; 36/3 R

[58] Field of Search ..... 36/3 R, 3 A, 3 B, 36/29, 114

[56] References Cited

U.S. PATENT DOCUMENTS

| | | | |
|---|---|---|---|
| 1,660,698 | 2/1928 | Williams, Sr. | 36/2 R |
| 2,354,407 | 7/1944 | Shaks . | |
| 2,558,973 | 7/1951 | Meaker | 36/3 B |
| 2,716,293 | 8/1955 | Rath . | |
| 3,027,659 | 4/1962 | Gianola . | |
| 4,860,463 | 8/1989 | Pin . | |
| 5,068,981 | 12/1991 | Jung . | |
| 5,341,587 | 8/1994 | Huang | 36/3 B |

FOREIGN PATENT DOCUMENTS

| | | | |
|---|---|---|---|
| 0550079 | 8/1956 | Belgium | 36/3 R |
| 0547724 | 6/1993 | European Pat. Off. . | |
| 9101837 | 6/1991 | Germany . | |
| 9210118 | 11/1992 | Germany . | |
| 0538325 | 7/1956 | Italy | 36/3 B |
| 2245145 | 1/1992 | United Kingdom | 36/3 B |
| WO90/10396 | 9/1990 | WIPO . | |

*Primary Examiner*—Paul T. Sewell
*Assistant Examiner*—Ted Kavanaugh
*Attorney, Agent, or Firm*—Frishauf, Holtz, Goodman, Langer & Chick

[57] ABSTRACT

Ventilation of shoes is efficiently performed by converting an ambulatory movement of the pumping moment of a ventilator in order to eliminate stuffiness and odor in the shoes. The ventilator is comprised of an air groove having a plurality of ventilating holes on the shoe sole, a pump provided inside the heel which returns to the original shape by releasing the stepping in the ambulatory movement, a first unidirectional valve connected between the air groove and the pump which opens/closes the valve by the pressure of the pump, and a second unidirectional valve for ventilating the air.

14 Claims, 9 Drawing Sheets

VENTILATING SHOES

BACKGROUND OF THE INVENTION

The present invention relates to ventilating the shoes having a ventilator for ventilating inside of a shoe during ambulatory movement.

Conventionally, various shoes are produced to improve wearing comfort by ventilating the inside of the shoes via ventilating holes to release damp air or odor in the shoes to the outside.

However, since the structure of such shoes is such that the inside and outside of each shoe are simply connected, ventilation could not be performed efficiently. To solve the above problem, ventilation means for forcefully ventilating air is proposed. However, to provide such ventilation means in a limited space such as a shoe sole, a compact pump with a small valve connected to the pump is needed. In addition, the shoes need to withstand various walking conditions such as dusty roads, wet streets or muddy surfaces. Accordingly, mass production of such shoes is difficult.

SUMMARY OF THE INVENTION

In light of the above problems, it is an object of the present invention to provide ventilating shoes capable of performing ventilation inside the shoes, and releasing stuffy air and odor by utilizing a ventilator in the shoe using a unidirectional (one-way) valve sole, and converting the ambulatory movement into a pumping movement.

It is another object of the present invention to provide ventilating shoes capable of saving materials for the shoe sole by utilizing the cavity which was originally made to reduce the weight of the shoe.

According to the present invention, the foregoing object is attained by a ventilating shoe including a ventilator which is operated by ambulatory movement, comprising: an air groove having a plurality of ventilating holes; a pump provided inside the heel portion so as to be pressurized by heel pressure, and expand to the original shape by releasing the heel pressure; a first unidirectional valve, provided between the air groove and the pump, which is closed by the compression of the pump, and opened by the expansion of the pump; and a second unidirectional valve, branched off from the portion between the pump and the first unidirectional valve so as to communicate to the atmosphere, for performing ventilation by being opened by the compression of the pump and closed by the expansion of the pump.

According to the present invention, the foregoing object is attained by a ventilating shoe including a ventilator which is operated by ambulatory motion, comprising: an insole having a predetermined strength and a plurality of ventilating holes; a sole, to which a heel is incorporated, having a predetermined strength where a plurality of air grooves are integrated into a single air passage at a meeting portion; a pump provided inside the heel which is pressurized by heel pressure, and which returns to the original shape by releasing the heel pressure; a first unidirectional valve, connected between the meeting portion and the pump via a joint, which is closed by the compression of the pump or opened by the expansion of the pump; and a second unidirectional valve, branched off from the joint so as to connect to the outside of the shoe, which is opened by the compression of the pump, and is closed by the expansion of the pump.

According to the present invention, the foregoing object is attained by a ventilating shoe including a ventilator which is operated by ambulatory motion, comprising: an insole having a predetermined strength which functions as a component of the shoe, and a plurality of ventilating holes; a sole, to which a heel is incorporated, having a predetermined strength where a plurality of air grooves are integrated into one at a meeting portion; a pump provided inside the heel which is compressed by heel pressure, and expanded to the original shape by releasing the heel pressure; a first unidirectional valve, connected between the meeting portion and the pump via a joint, which closes the compression of the pump or opens by the expansion of the pump; and a second unidirectional valve, branched off from the joint so as to connect to the outside of the shoe, which is opened by the pressure of the pump, and is closed by the recovery of the pump, and the pump of the ventilator is contained inside of the heel which is incorporated into the sole, and the joint, first unidirectional valve and second unidirectional valve are embedded in the space under the arch of the foot in the sole.

According to the present invention, the foregoing object is attained by a ventilating shoe having a ventilator which is operated by ambulatory movement, comprising: an air groove having a plurality of ventilating holes; a pump which is pressurized by heel pressure in the ambulatory movement, and expended to the original shape by releasing the heel pressure; a first unidirectional valve, provided between the air groove and the pump via a filter, which is closed by the compression of the pump, and opened by the expansion of the pump; and a second unidirectional valve, branched off from the portion between the pump and the first unidirectional valve so as to communicate to the atmosphere, for performing ventilation by being opened by the compression of the pump and closed by the expansion of the pump.

With the above structure, a positive pressure generated by the pump in the heel closes the first unidirectional valve when a heel pressure of the ventilating shoes is generated in the ambulatory movement, and air is released to the outside via the second unidirectional valve. When the heel pressure is released, an inner negative pressure is generated, and the second unidirectional valve is closed, while the first unidirectional valve is opened. The air inside the shoe is taken into the pump via the air grooves having a plurality of ventilating holes connected to the first unidirectional valve.

The space formed in the sole is efficiently used by containing the pump in the heel portion which is incorporated into the shoe sole, and embedding the first and second unidirectional valves in the space at the arch of foot on the sole.

A ventilating function can be maintained for a long time by preventing dust into the first unidirectional valve by a filtering means.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

Figure 1:
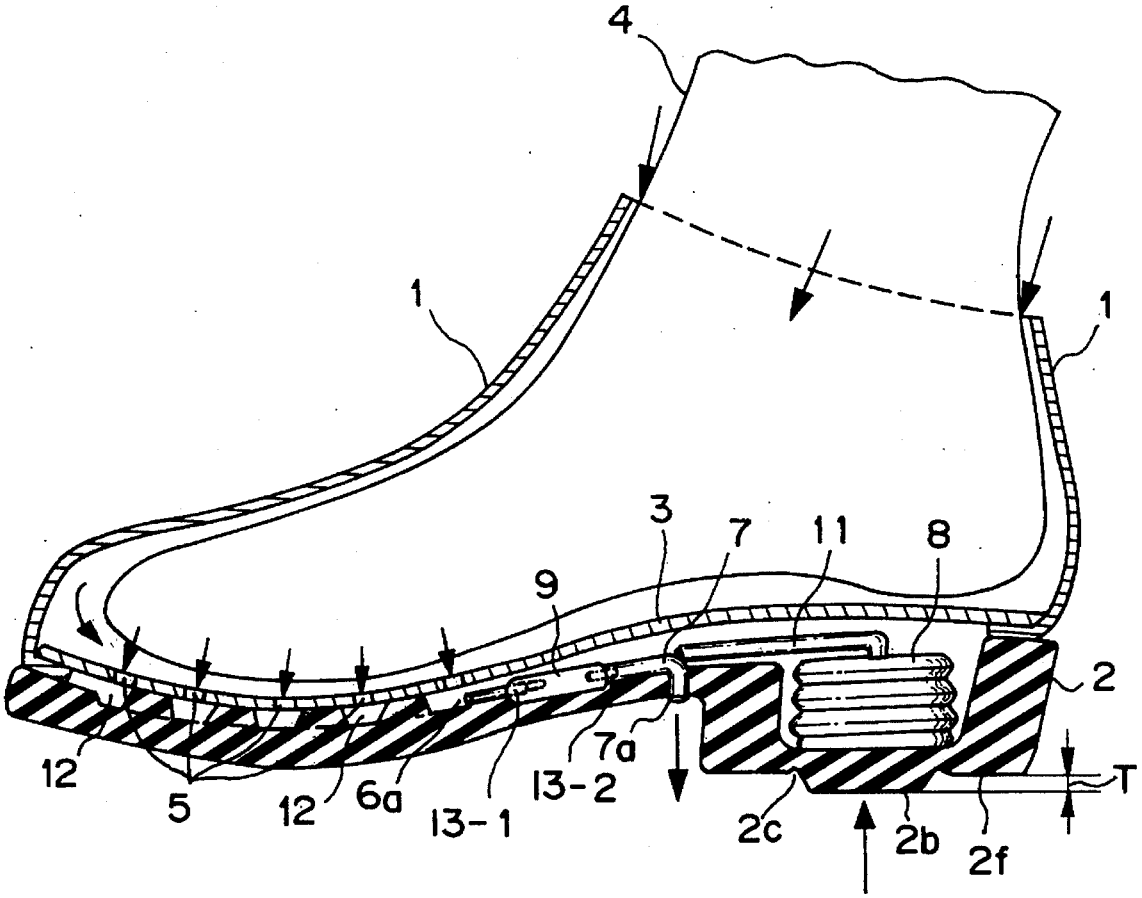
FIG. 1 is a cross-sectional view of the case where a person is wearing the shoes of an embodiment according to the present invention.
Figure 3A:
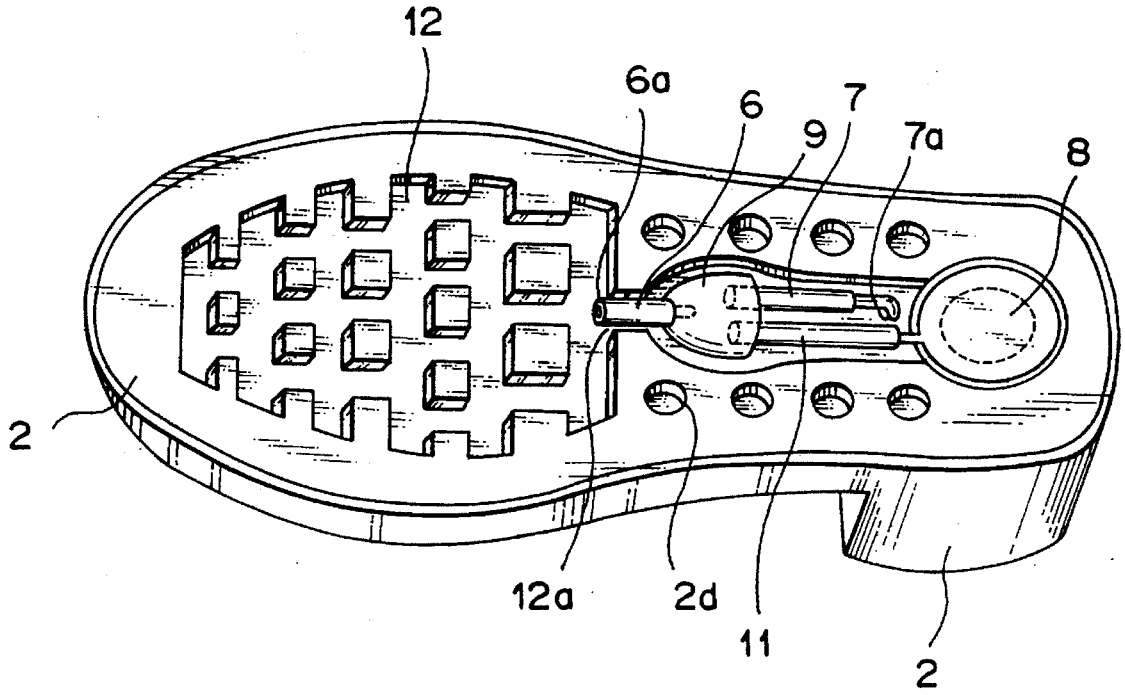
FIG. 3A is a perspective view of the sole of the shoe of FIG. 1.

FIG. 1 is a cross-sectional view of a shoe of the embodiment. In FIG. 1, the shoe which is mainly composed of sole 2, insole 3 and upper 1 fits to the foot 4. The insole 3 has a plurality of ventilating holes 5 around the toe tip, and ventilation is performed by these ventilating holes 5. Furthermore, the ventilating holes 5 are placed so as to correspond to the positions of the air holes 12 provided in the sole 2. The air holes 12 are integrated at the meeting portion 12*a* (FIG. 3A). The ventilator takes the air inside the shoe in the arrow's direction via the inlet 6*a* at the meeting portion 12*a*, while exhausting the air inside the shoe to the outside via the exhaustion unit 7 having an outlet 7*a* at the tip of the exhaustion unit 7. Furthermore, a cylindrical bellows pump 8 having a plurality of folds connects the inlet 6*a* and outlet 7*a* respectively via the air transmission unit 11. The sole with the above-described constitution is made into the heel by using polyurethane resin, natural rubber, synthetic rubber, mixture of natural rubber and synthetic rubber, and sponge rubber and RB rubber having a predetermined strength. Furthermore, the heel portion can be comprised of material different from the sole.

Figure 2:
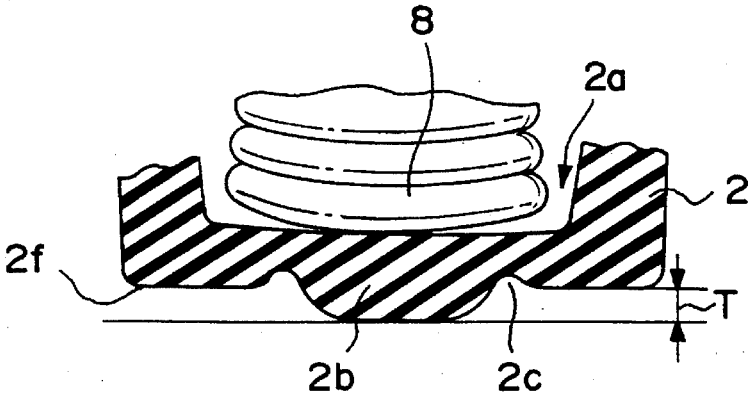
FIG. 2 is a cross-sectional view of the heel portion of the shoe of FIG. 1.

FIG. 2 is a cross-sectional view where the main body of the pump 8 is contained in the internal space of the heel. The heel portion is comprised of a concavity 2*a*, the space having a flat bottom in a substantially circle shape to contain the pump 8, a convexity 2*b*, in a substantially circle shape, located beneath the concavity 2*a* projected by thickness T, and a ring-shape groove 2*c* provided around the convexity 2*b*.

Figure 3B:
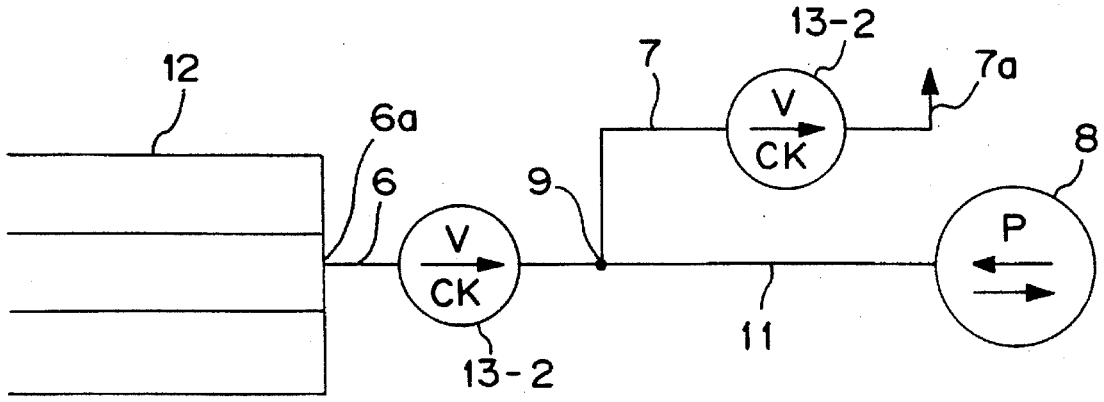
FIG. 3B is a diagram illustrating the arrangement of the pipes of the shoe of FIG. 1.

FIG. 3A is a perspective view of the sole 2 without the upper 1 and insole 3. FIG. 3B is a diagram illustrating the arrangement of the pipes of FIG. 3A. Since the air grooves 12 are connected to a plurality of ventilating holes 5 of the insole 3 when the components are assembled as a shoe, an air flow passage is formed, and the air inside of the shoe is taken from the rear end of the air grooves 12. At the rear end of the air groove 12, the above-described inlet 6*a* is provided, and connected to the joint 9, pump 8 and outlet 7*a*. A plurality of concavities 2*d* (FIG. 3A) on the sides of the joint 9 are made to reduce the weight of the shoe.

Figure 4:
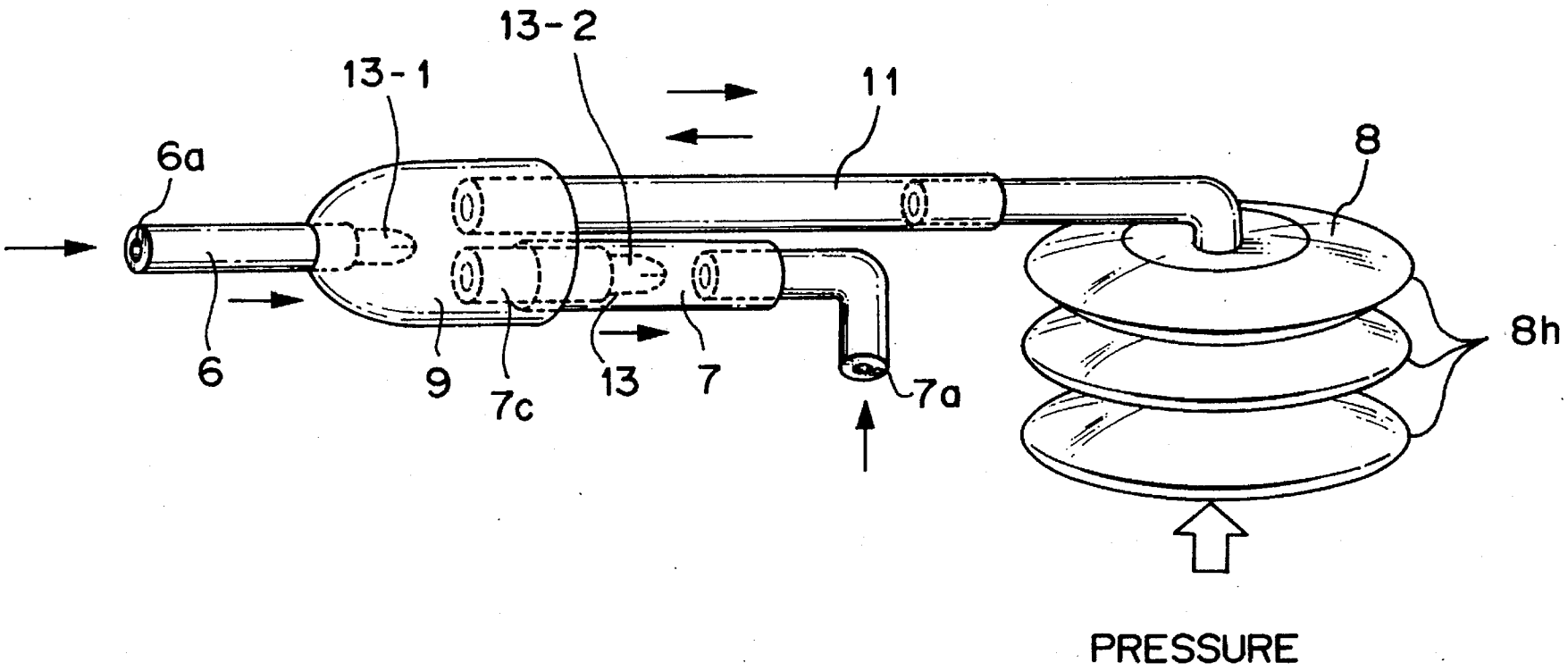
FIG. 4 is a perspective view of the assembled ventilator.
Figure 5:
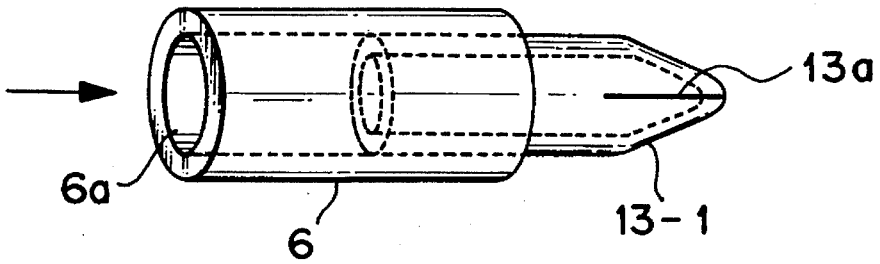
FIG. 5 is a perspective view of the suction unit of the ventilator shown in FIG. 4.
Figure 12:
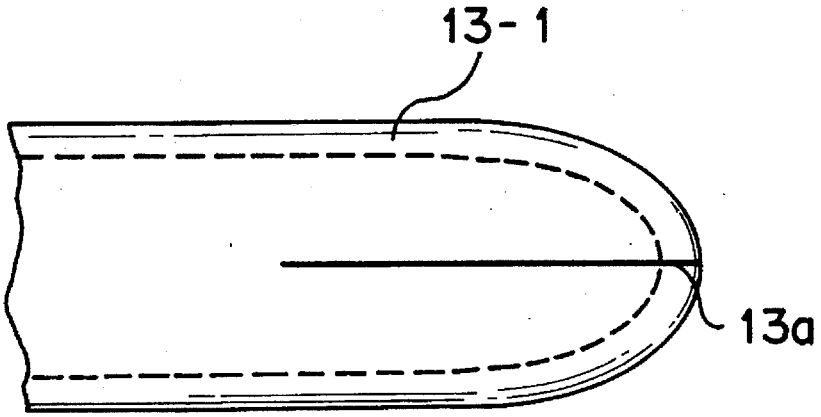
FIG. 12 is a view of a partial air valve of the ventilator of the embodiment.
Figure 13:
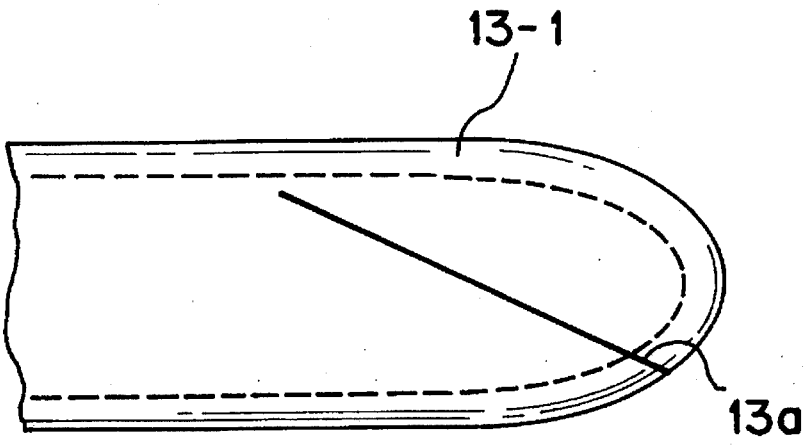
FIG. 13 is a view of a partial air valve of the ventilator of another embodiment.

FIG. 4 shows the assembled ventilator before being installed in the sole 2. The suction unit 6 having the inlet 6*a* at one end is shown in detail in FIG. 5. The suction unit 6 is formed as a pipe comprising of hard material such as polyvinyl chloride, ABS resin, polypropylene, wood or bamboo. On the other end of the suction unit 6*a*, a unidirectional valve 13-1 is inserted. The detail of the unidirectional valve 13-1 is shown in FIG. 12. The air valve 13-1 is formed of elastic material such as rubber, soft polyvinyl chloride and AR synthetic rubber whose shape like a bullet. The base of the unidirectional valve 13-1 is open, and the tip is provided with the slit 13*a* which functions as a valve. This slit 13*a* can be a single slit or cross shape slit from the view point of the head of the unidirectional valve 13-1, or a single slant slit as shown in FIG. 13.

Figure 6:
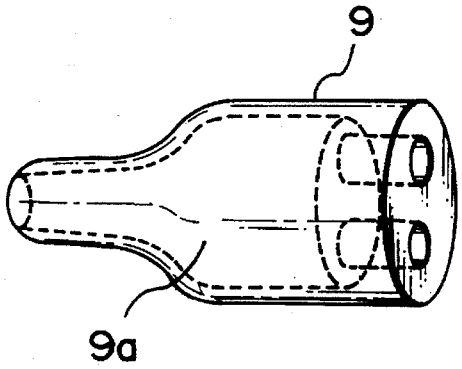
FIG. 6 is a perspective view of the joint of the ventilator shown in FIG. 4.
Figure 7:
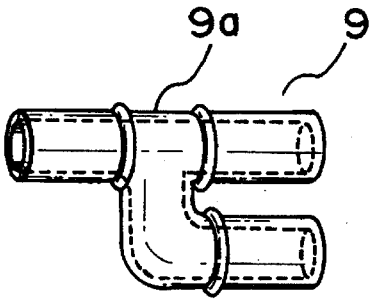
FIG. 7 is a perspective view of another embodiment of the joint of the ventilator shown in FIG. 4.

The suction unit 6 on the side of the unidirectional valve 13-1 is further inserted into the joint 9. FIGS. 6 and 7 are the detail of the joint 9. The joint 9 includes a branch unit 9*a*, as shown in FIGS. 6 and 7, which unites the suction unit 6, exhaustion unit 7 and air transmission unit 11. After the assembling, these units are assembled to maintain air tightness.

Figure 8:
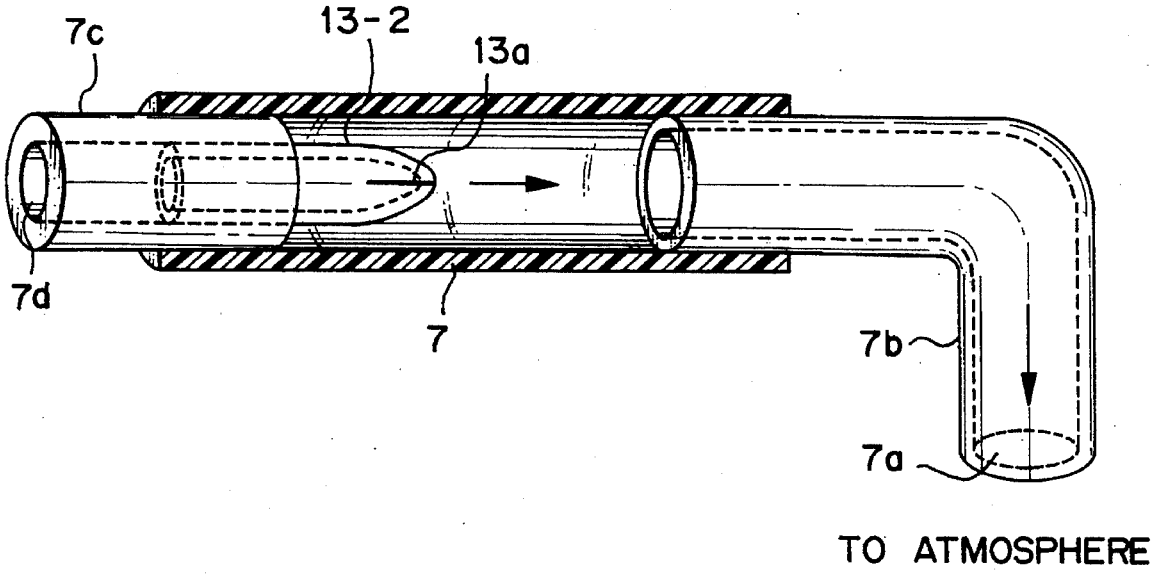
FIG. 8 is a fragmentary sectional view of the exhaustion unit of the ventilator shown in FIG. 4.
Figure 9:
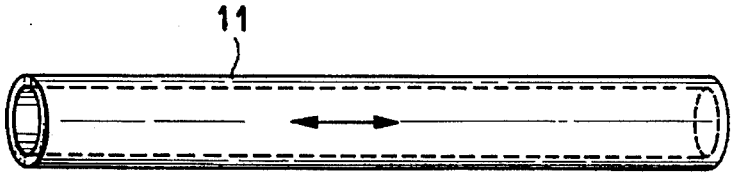
FIG. 9 is an exterior view of the air transmission-unit of the ventilator shown in FIG. 4.

The exhaustion unit 7 inserted into one end of the branch unit 9*a* is described with reference to FIG. 8. The main body of the exhaustion unit 7 is a pipe made from soft material. The soft pipe 7*c* to which the unidirectional valve 13-2 is inserted is further inserted into one branch of the branch unit 9*a*. The unidirectional valve 13-2 is of the same type as that of the unidirectional valve 13-1. The discharge pipe 7*b* made from soft material is inserted into the other end of the exhaustion unit 7. The discharge pipe 7*b* is bent so as to discharge air to the bottom or side of the shoe sole, and its opening is outlet 7*a*. The air transmission unit 11 is shown in FIG. 9. The air transmission unit 11 which is inserted into the other branch of the branch unit 9*a* is made from soft material, and performs air transmission between the pump 8 and the joint 9.

Figure 10:
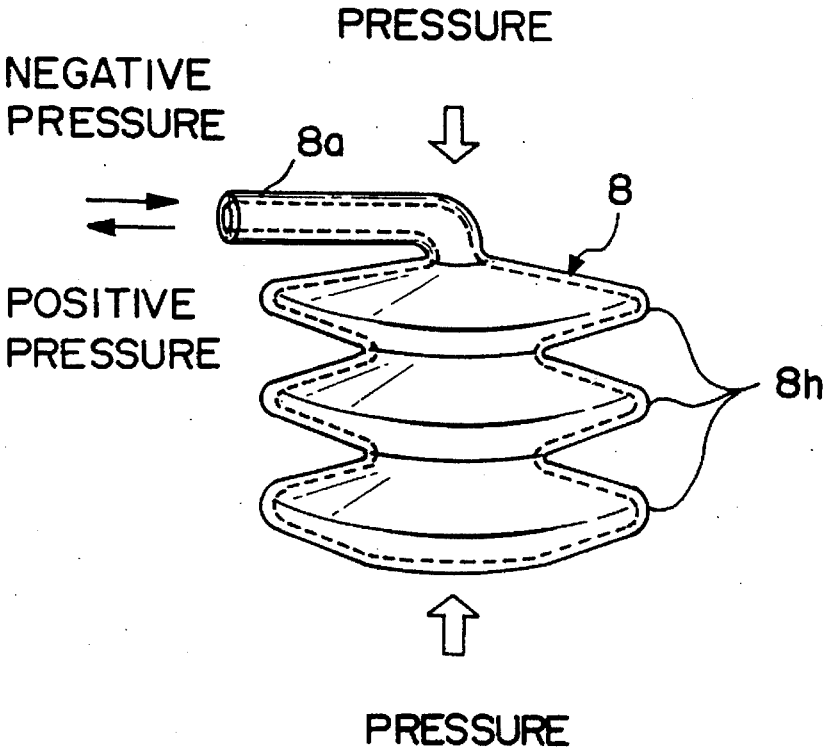
FIG. 10 is a perspective view of the pump.
Figure 11:
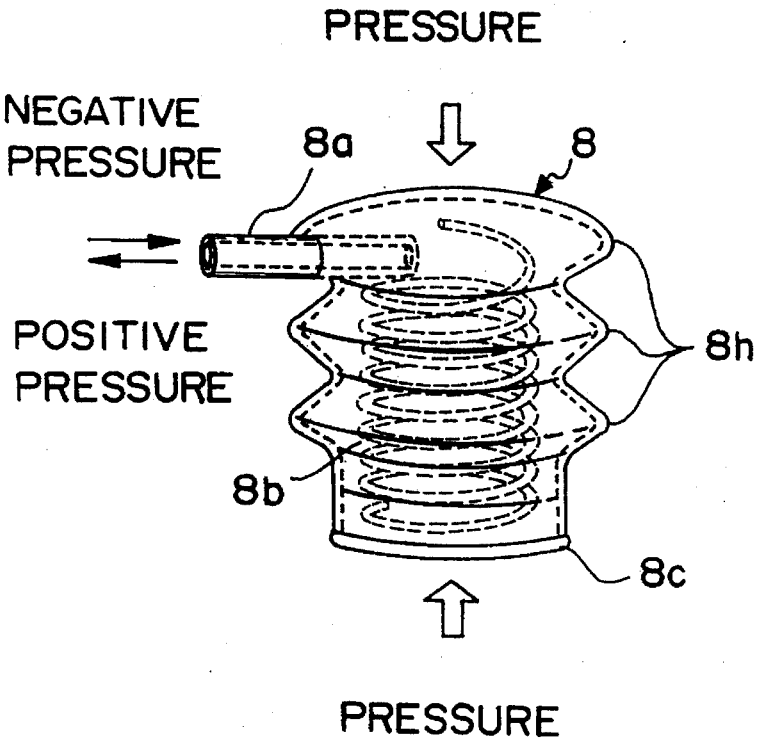
FIG. 11 is the perspective view of another embodiment of the pump.

The detail of the pump 8 is shown in FIGS. 10 and 11. The pump 8 is made from elastic rubber or recoverable materials such a polyethylene, "LINIREX, L-LDPE" (registered trademark of HIHON SEKIYU KAGAKU), polypropylene and styrene butadiene rubber. The pump 8 is cylindrical in shape having three folds 8*h* which contains air. The bottom of the pump 8 is closed, and the upper portion is a pipe shape. The pipe has an opening 8*a*, and is inserted into the transmission unit 11. When the pressure is released by exhausting the air inside of the pump 8 with respect to the pressure from the outside by the elasticity of the material and the operation of the folds, the pump recovers to the original shape. The pump of FIG. 11 is similar to the pump of FIG. 10. However, FIG. 11 differs from FIG. 10 in that the bottom is opened and closed by the separate cover 8*c* by glue or similar means, after the spring 8*b* is set inside of the pump 8.

The operation of the shoe having the ventilator of FIG. 4 assembled in the above-described manner is contained in the sole 2 with the insole 3 and upper 1 is described below. When a person walks with these shoes, the convexity 2*b* projected thickness T (approximately 5–10 mm) from the heel surface 2*f* pushes up the bottom of the pump 8. Since the upper portion of the pump 8 is fixed on the insole 3, the air in the pump 8 is compressed, and air is sent to the joint 9, via the air transmission 11, where the unidirectional valve 13-1 of the suction unit 6 (a first unidirectional valve) and the unidirectional valve 13-2 of the exhaustion unit 7 (a second unidirectional valve) are pressurized.

Figure 14:
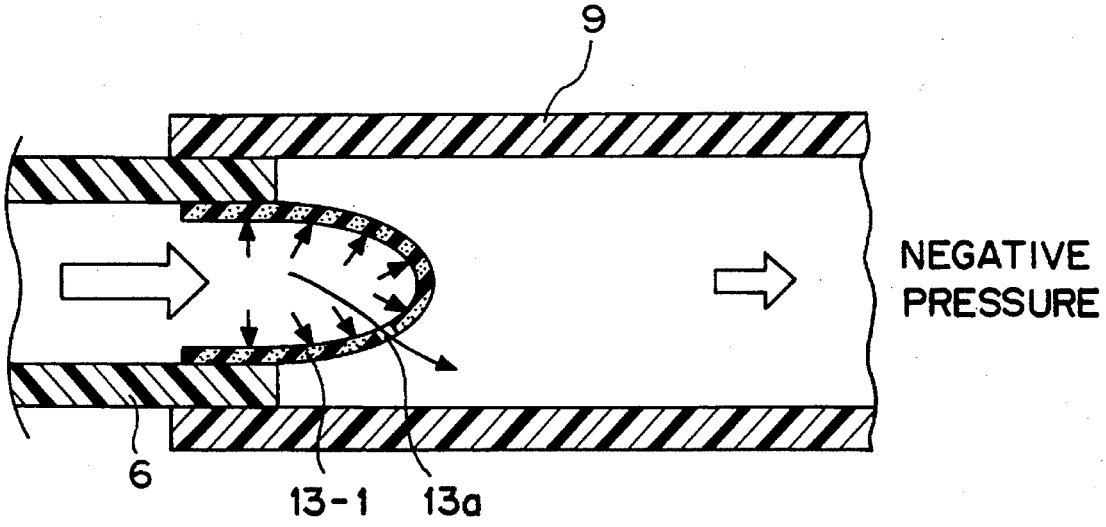
FIG. 14 is a diagram illustrating the operational state when the air valve opens.
Figure 15:
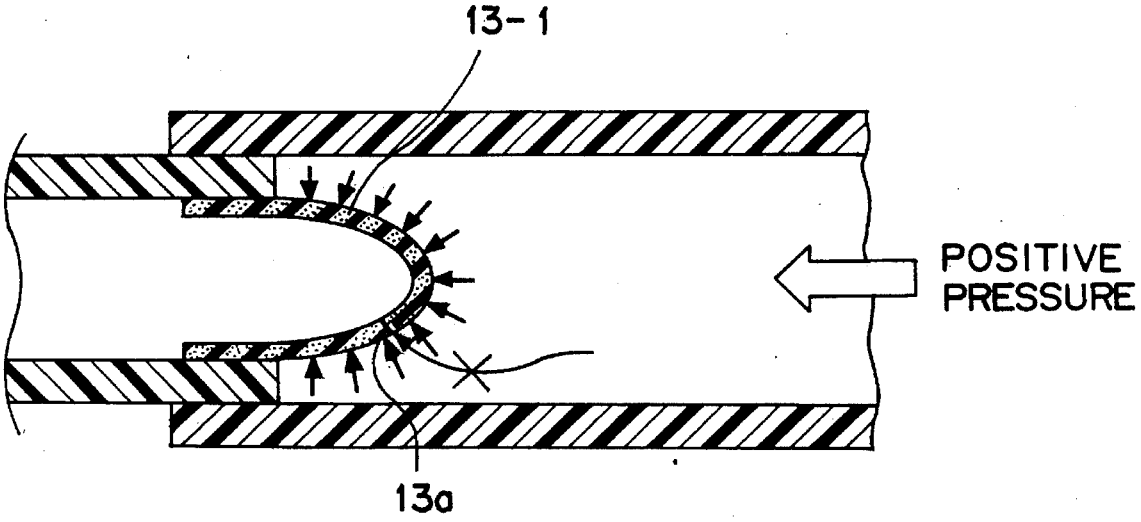
FIG. 15 is a diagram illustrating the operational state when the air valve closes.

The operational state of the unidirectional valve 13-1 is shown in FIGS. 14 and 15. FIG. 14 is a diagram illustrating the case where the unidirectional valve 13-1 is subject to negative pressure. The air flows through the opening of the unidirectional valve 13-1, that is, from the inside of suction unit 6 to the outside, but does not flow from the outside to the inside since the pressure inside is greater. This is because the unidirectional valve 13-1 is a bullet shape. In this shape, if the air inside of the valve is pressurized, a force to open the slit 13*a* to the outside is generated, and air flows out. FIG. 15 is a diagram illustrating the case where the unidirectional valve 13-1 is subject to positive pressure, i.e. outside pressure is greater. Since the unidirectional valve 13-1 is a bullet shape, when the positive pressure acts on the outside of the valve, a force to close the slit 13*a* is generated, and the air inside the valve 13-1 is prevented from flowing out. As the pressure increases, the force to open/close the slit 13*a* increases. The operating principal of unidirectional valve 13-2 is similar to that of unidirectional valve 13-1. As described above, both the first unidirectional valve and second unidirectional valve are constituted almost in the same manner.

As described above, ventilation is performed when the air flows only in one direction by using unidirectional valve 13-1 and 13-2. That is, in the joint 9, since unidirectional valve 13-1 connected to the suction unit 6 is arranged to close to positive pressure, while the unidirectional valve 13-2 connected to the exhaustion unit 7 is arranged to open when the pump 8 is pressed, air can be released to the atmosphere via the outlet 7*a*. Furthermore, when the pressure in the pump 8 is zero, the unidirectional valve 13-2 is automatically closed by elasticity.

When the shoe leaves the surface of the land, since the load on the convexity 2 and the pressure on the pump 8 are eliminated, the pump 8 is subject to a recovering force, and returns to the original shape by its own elasticity. The negative pressure generated at the returning process becomes a suction force which acts on the joint 9 via the unidirectional transmission unit 11. The slit 13*a* of the unidirectional valve 13-2 of the exhaustion unit 7 closes due to the negative pressure. On the other hand, since the unidirectional valve 13-1 of the suction unit 6 opens in the above-described manner, stuffy air in the shoe is drawn by the pump 8 via the joint 9*a*. Ventilation is performed by repeating the above operation along with ambulatory motion.

As described in FIG. 1, the ventilation of the unidirectional between the upper 1 and foot 4 is performed via the plurality of ventilating holes 5 and the corresponding air grooves 12 of the sole 2. Air in the shoe is sucked by the pump 8 from the inlet 6*a*, and discharged to the outside by the outlet 7*a*. Furthermore, ventilation around the toe tip can be efficiently performed.

The amount of ventilated air depends on the capability of the pump 8, however, air of approximately 2–3 $cm^3$ can be exchanged per pumping. In case of men's shoes, the capacity of the internal space of the shoe varies from 7–8 $cm^3$ to 10–15 $cm^3$ at most. Accordingly, in several steps, the entire volume of air in the shoes can be exchanged.

Figure 16:
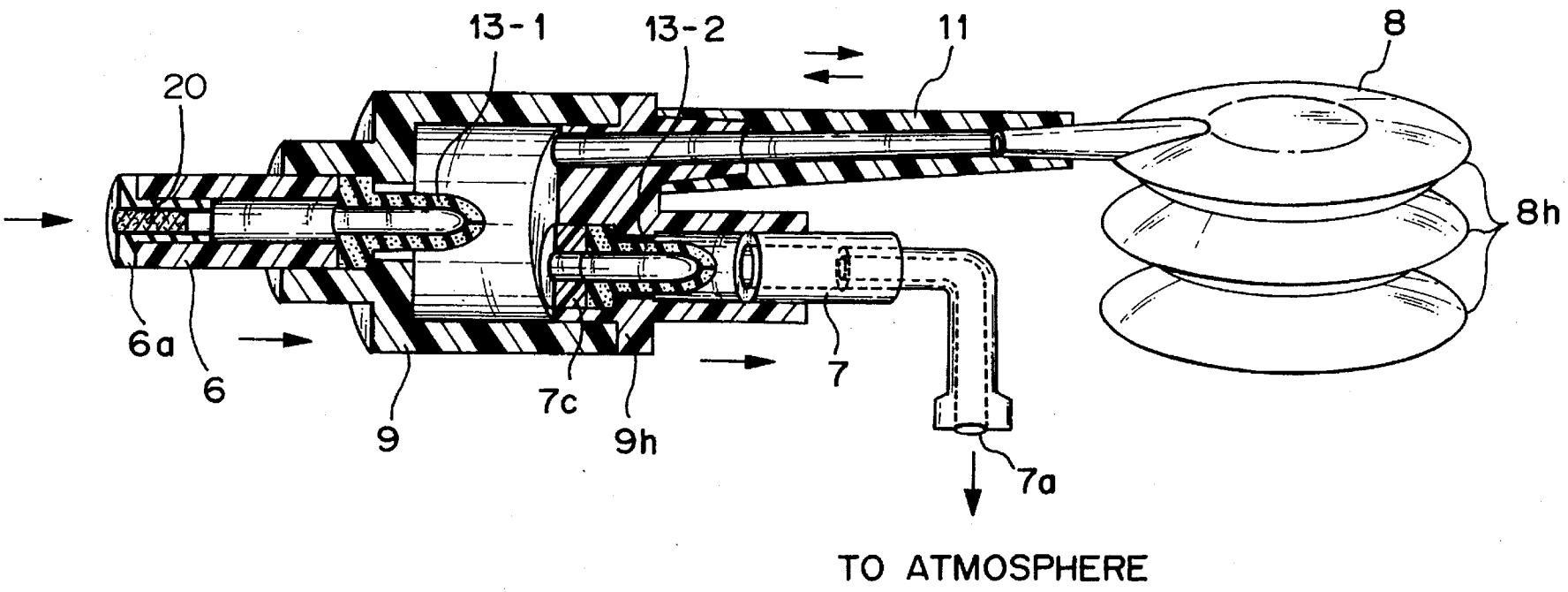
FIG. 16 is a perspective view of the assembled ventilator of another embodiment.

FIG. 16 is a partial sectional view of the assembled ventilator contained in the sole 2. The description of the structural components which have been already described is not needed. However, a filter 20 is inserted into the inlet 6*a* to prevent the pipe from choking with dust. A result, the slit 13*a* is protected from the choking, and can function properly for a long period of time.

Furthermore, in FIG. 16, assembling is simplified when the joint 9 is provided with the cover 9*h*. Furthermore, each part can be produced simply by injection resin molding.

In the above embodiments, men's shoes whose upper is below the anklebone are described. However, this does not impose a limitation upon the invention. For example, the invention can be applied to boots, sports shoes, mountain-climbing boots, women's shoes and children's shoes.

The present invention is not limited to the above-described embodiments. For example, if a shoe has a ventilator for discharging the air in a shoe by pumping means driven by ambulatory movement, various modifications are possible. The ventilator is also not limited to a separate pump, for pump and valves can be incorporated into one unit and contained on the heel portion to reduce the size.

As many apparently widely different embodiments of the present invention can be made without departing from the spirit and scope thereof, it is to be understood that the invention is not limited to the specific embodiments thereof except as defined in the appended claims.

What is claimed is:

1. A ventilating shoe including a ventilator which is operated by ambulatory movement, and which comprises a valve arrangement which includes only first and second unidirectional valves, the ventilating shoe comprising:

an air groove formed between an insole and a sole of the shoe, said insole having a plurality of ventilating holes formed therein and said insole having a strength so as to function as a component of the shoe while having said plurality of ventilating holes therein, and said sole having a strength so as to function as a component of the shoe;

a pump which is incorporated into a cylindrical bellows shape using a resin material and being provided inside a heel portion of the shoe so the cylindrical bellows is pressurized and compressed by heel pressure, and the cylindrical bellows expanding to an original shape thereof upon releasing of the heel pressure;

said first unidirectional valve which comprises a hollow body formed from elastic material, said hollow body of said first unidirectional valve being substantially in a bullet shape having a tapering head which has at least a single slit therein, and said first unidirectional valve being coupled between said air groove and said pump, which slit is closed by a compression of the cylindrical bellows of the pump, and opened by an expansion of the cylindrical bellows of the pump; and said second unidirectional valve which comprises a hollow body formed from elastic material, said hollow body of said second unidirectional valve being substantially in a bullet shape having a tapering head which has at least a single slit therein, and said second unidirectional valve being branched off from a meeting portion between said pump and said first unidirectional valve so as to communicate to the atmosphere outside of said shoe, for performing ventilation by being opened by the compression of the cylindrical bellows of the pump and being closed by the expansion of the pump.

2. The ventilating shoe according to claim 1, wherein:

said air groove is provided from a toe tip of the shoe to an arch portion of the shoe; and said first unidirectional valve and said second unidirectional valve are embedded under the arch portion of the shoe in the sole so as to connect to the pump via an air transmission pipe.

3. The ventilating shoe according to claim 1, wherein a convex projection from a large contacting surface of the heel corresponds to a bottom of the pump and is pressurized by the heel pressure in an ambulatory movement.

4. The ventilating shoe according to claim 3, comprising a ring-shaped concavity provided around said convex projection.

5. The ventilating shoe according to claim 1, wherein said resin material of said cylindrical bellows is polyethylene.

6. The ventilating shoe according to claim 1, wherein said resin material of said cylindrical bellows is styrene butadiene rubber.

7. The ventilating shoe according to claim 1, wherein said pump further includes a compression spring coupled to said cylindrical bellows to enhance expansion of said cylindrical bellows to the original shape thereof upon releasing of the heel pressure.

8. The ventilating shoe according to claim 1, comprising a concavity formed in the vicinity of a space under the arch portion of the shoe to reduce an amount of material for forming the sole.

9. The ventilating shoe according to claim 1, wherein said sole is formed of a polyurethane rubber resin.

10. The ventilating shoe according to claim 1, wherein said sole comprises natural rubber.

11. The ventilating shoe according to claim 1, wherein said sole is formed of a sponge rubber having a predetermined strength.

12. The ventilating shoe according to claim 1, wherein said sole is formed of a thermal plasticity rubber.

13. The ventilating shoe according to claim 1, wherein said sole comprises synthetic rubber.

14. The ventilating shoe according to claim 1, comprising a plurality of said air grooves, each of said air grooves communicating with a plurality of ventilating holes in said insole, and each of said air grooves communicating with said pump via said first unidirectional valve.

* * * * *